US008689471B2

(12) United States Patent
Carpenter et al.

(10) Patent No.: US 8,689,471 B2
(45) Date of Patent: Apr. 8, 2014

(54) METHOD AND SYSTEM FOR CONTROLLING AN EXCAVATOR

(75) Inventors: Hamish John Carpenter, Christchurch (NZ); Richard Paul Piekutowski, Huber Heights, OH (US); Mark Nichols, Christchurch (NZ)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 59 days.

(21) Appl. No.: 13/527,095

(22) Filed: Jun. 19, 2012

(65) Prior Publication Data

US 2013/0333364 A1 Dec. 19, 2013

(51) Int. Cl.
*E02F 3/43* (2006.01)
*E02F 9/22* (2006.01)

(52) U.S. Cl.
USPC ..... 37/348

(58) Field of Classification Search
USPC ..... 37/466, 347, 348; 172/2–11; 701/50, 701/54, 85; 60/427, 428, 452, 484, 426, 60/431, 433, 434, 328; 417/216; 180/321
See application file for complete search history.

(56) References Cited

U.S. PATENT DOCUMENTS 3,779,084 A 12/1973 Nilsson
4,712,376 A * 12/1987 Hadank et al. ..... 60/427
4,866,641 A 9/1989 Nielsen et al.
4,942,737 A * 7/1990 Tatsumi ..... 60/431
5,201,177 A * 4/1993 Kim ..... 60/426
5,535,532 A 7/1996 Fujii et al.
5,682,311 A 10/1997 Clark
5,809,846 A * 9/1998 Ohkura et al. ..... 74/733.1
5,854,988 A 12/1998 Davidson et al.
5,933,346 A 8/1999 Brabec et al.
6,076,029 A 6/2000 Watanabe et al.
6,381,882 B1 5/2002 Mizutani et al.
6,498,973 B2 * 12/2002 Dix et al. ..... 701/50
6,729,050 B2 5/2004 Whitten et al.
7,810,260 B2 10/2010 Pope et al.
7,832,126 B2 11/2010 Koellner et al.
7,869,923 B2 1/2011 Kawaguchi
2008/0047170 A1 2/2008 Nichols

* cited by examiner

*Primary Examiner* — Robert Pezzuto
(74) *Attorney, Agent, or Firm* — Dinsmore & Shohl LLP

(57) ABSTRACT

A control for an excavator of the type having a plurality of hydraulic cylinders for moving excavator components such that digging is accomplished at a worksite with an excavator bucket or other excavator implement, includes a plurality of hydraulic control valves, each of which is associated with a respective one of the hydraulic cylinders for controlling the application of hydraulic fluid pressure to the respective one of the hydraulic cylinders, and a plurality of manually actuated joystick valves for supplying hydraulic fluid pressure to the respective hydraulic control valves to control the movement of the hydraulic cylinders. The control includes a sensor arrangement for sensing the position of one or more excavator components.

20 Claims, 3 Drawing Sheets

METHOD AND SYSTEM FOR CONTROLLING AN EXCAVATOR

CROSS-REFERENCE TO RELATED APPLICATIONS

None

STATEMENT REGARDING FEDERALLY SPONSORED RESEARCH OR DEVELOPMENT

Not Applicable.

BACKGROUND

This relates to a control for an excavator of the type in which an operator manually actuates joystick valves to supply hydraulic fluid to hydraulic control valves. The hydraulic control valves then in turn supply hydraulic fluid to hydraulic cylinders or motors to move the various excavator components. In a typical excavator, a boom extends from the excavator chassis, and is pivotally connected to a dipper stick. The dipper stick is pivotally connected to an excavator bucket or other excavator implement. The excavator chassis can be pivoted on the excavator undercarriage, typically by an hydraulic motor. The hydraulic cylinders pivot the boom with respect to the chassis, pivot the dipper stick with respect to the boom, and pivot the bucket or other excavator implement with respect to the dipper stick. Another common excavator configuration includes a second boom component which allows the boom to bend. This is often referred to as a variable angle boom or a VA boom, and permits work indoors or in areas having clearance restrictions, such as under power lines.

The operator of such an excavator manipulates joystick control levers which actuate the joystick valves to effect digging with the excavator bucket. The operator may be aided in this operation by a display in the cab of the excavator that shows the current elevation of the excavator bucket and the desired elevation of the worksite. Various sensors have been used to determine the bucket elevation, including laser sensors that sense a reference beam of laser light provided by a laser transmitter positioned at a distance from the excavator. GPS receivers also have been used to determine bucket elevation. Since the laser receivers and GPS receivers are typically not mounted directly on the excavator bucket, such receivers typically have been used to determine the location of a reference point on the excavator, and then the outputs from additional sensors, such as angle encoders and inclinometers, have been used to determine the position of the bucket relative to the reference point. A map of the desired contour of the worksite is typically stored in a memory associated with the excavator control so that the operator can be provided with a continuous display showing the amount of additional digging required to reach the desired elevation.

The skill and experience of excavator operators vary significantly, with the most skilled operators being able to dig to a final grade level much more quickly than those less skilled. Previous attempts at providing control of excavators had the system actively control one or more members of the excavator while the operator controlled the others. It was difficult for the operator to coordinate motions with the automatic systems which were slower than the operators and, effectively, the result was not as efficient as an operator digging without the automatic control. To dig to a desired contour or a line requires coordinated and constantly varied adjustment of the various members by the operator to maintain the cutting edge tangent to the desired path. Less experienced excavator operators have difficulty adequately coordinating the motions of the members simultaneously and may dig too deeply in some areas of the worksite, requiring that fill material be added to those areas later. It will be appreciated that returning fill material to the low areas of the worksite can be time consuming. Further, it may be necessary to compact the fill material in some instances, adding to the cost of the excavation operation. An excavator control and method are needed in which the efficiency of the operation of the machine is enhanced.

SUMMARY

An excavator has an excavator chassis pivotally mounted on an excavator undercarriage, a boom pivotally mounted on the excavator chassis, a dipper stick pivotally mounted on the boom, and an excavator implement, such as an excavator bucket, pivotally mounted on the dipper stick. The excavator further has a first hydraulic device for moving the bucket with respect to the dipper stick, a first hydraulic control valve for controlling the application of hydraulic fluid to the first hydraulic device, a second hydraulic device for moving the dipper stick with respect to the boom, second hydraulic control valve for controlling the application of hydraulic fluid to the second hydraulic device, a third hydraulic device for moving the boom with respect to the excavator chassis, a third hydraulic control valve for controlling the application of hydraulic fluid to the third hydraulic device, a fourth hydraulic device for rotating the chassis with respect to the undercarriage, and a fourth hydraulic control valve for controlling the application of hydraulic fluid to the fourth hydraulic device. Additionally, the excavator has manually actuated joystick valves for supplying hydraulic fluid pressure to the first, second, third and fourth hydraulic control valves, to control the movement of the first, second, third and fourth hydraulic devices, respectively. The excavator includes a plurality of sensors for sensing position, a memory storing the desired elevation of the worksite at the point being excavated, and a processor, responsive to the sensors and to the memory, for determining the position of the bucket. The processor compares the bucket position to the desired elevation of the worksite, and supplies movement retarding signals when the bucket approaches the desired elevation. A manifold provides hydraulic fluid pressure from the manually actuated joystick valves to the first, second, third and fourth hydraulic control valves, to actuate the first, second, third and fourth hydraulic control valves. The manifold further provides a portion of the hydraulic fluid pressure from the manually actuated joystick valves to the first, second, third and fourth hydraulic control valves in opposition to actuation of the first, second, third and fourth hydraulic control valves in response to the movement retarding signals from the processor when the bucket approaches the desired elevation. By this arrangement, the movement of the bucket below the desired elevation is opposed.

The manifold may include a first movement retarding valve, responsive to the movement retarding signals, for diverting a portion of the hydraulic fluid pressure from the manually actuated joystick valves to oppose actuation of the first hydraulic control valve, a second movement retarding valve, responsive to the movement retarding signals, for diverting a portion of the hydraulic pressure fluid from the manually actuated joystick valves to oppose actuation of the second hydraulic control valve, a third movement retarding valve, responsive to the movement retarding signals, for diverting a portion of the hydraulic fluid pressure from the manually actuated joystick valves to oppose actuation of the third hydraulic control valve, and a fourth movement retarding valve, responsive to the movement retarding signals, for diverting a portion of the hydraulic fluid pressure from the manually actuated joystick valves to oppose actuation of the fourth hydraulic control valve. The first, second, third, and fourth movement retarding valves may each comprise an electrically actuated proportional valve. The portion of the pressure that may be applied to retard a movement is determined by the amount of current that is applied to the electrical valve, and can be limited by setting a maximum current limit in the processor.

The first, second, third and fourth movement retarding valves may divert a portion of the maximum hydraulic fluid pressure available from the manually actuated joystick valves such that the movement of the hydraulic devices is slowed, but not necessarily stopped, as the bucket approaches the desired elevation. The portion of the hydraulic fluid pressure diverted by the movement retarding valves may increase or decrease as the bucket approaches the desired elevation, as determined by the evaluation of the sensor data.

A control for an excavator of the type having a plurality of hydraulic cylinders for moving excavator components such that digging or other operations are accomplished at a worksite with an excavator implement, such as an excavator bucket, a plurality of hydraulic control valves, each of which is associated with a respective one of the hydraulic cylinders for controlling the application of hydraulic fluid to the respective one of the hydraulic cylinders, and a plurality of manually actuated joystick valves for supplying hydraulic fluid pressure to the respective hydraulic control valves to control the movement of the hydraulic cylinders, includes a sensor arrangement for sensing the position of one or more excavator components such that the elevation of the excavator bucket at the worksite may be determined. A memory stores the desired elevation of the worksite, and a processor, responsive to the sensor arrangement and to the memory, determines the elevation of the excavator bucket. The processor compares the elevation of the excavator bucket to the desired elevation of the worksite, and supplies movement retarding signals when the excavator bucket approaches the desired elevation. A manifold provides hydraulic fluid pressure from the manually actuated joystick valves to the plurality of hydraulic control valves to actuate the hydraulic control valves, and provides a portion of the hydraulic fluid pressure from the manually actuated joystick valves to the hydraulic control valves in opposition to actuation of the hydraulic control valves in response to the movement retarding signals from the processor when the bucket approaches the desired elevation. By this arrangement, the movement of the bucket below the desired elevation is opposed but not prevented.

The manifold may include a plurality of movement retarding valves, responsive to the movement retarding signals, for diverting a portion of the hydraulic fluid pressure from the manually actuated joystick valves to oppose actuation of the plurality of hydraulic control valves. Each of the plurality of movement retarding valves may comprise an electrically actuated proportional valve. The plurality of movement retarding valves divert a portion of the hydraulic fluid pressure from the manually actuated joystick valves such that the movement of the hydraulic cylinders is slowed but not stopped as the bucket approaches the desired elevation to optimize the resulting sum of the movement of the hydraulic cylinders. The portion of the hydraulic fluid pressure diverted by the movement retarding valves can be varied as the bucket approaches the desired elevation to optimize the speed of each cylinder such that the bucket does not go below the desired grade.

A method of controlling an excavator of the type having a plurality of hydraulic cylinders for moving excavator components such digging or another excavator operation is accomplished at a worksite with an excavator bucket or other excavator implement, a plurality of hydraulic control valves, each of which is associated with a respective one of the hydraulic cylinders for controlling the application of hydraulic fluid pressure to the respective one of the hydraulic cylinders, and a plurality of manually actuated joystick valves for supplying hydraulic fluid pressure to the respective hydraulic control valves to control the movement of the hydraulic cylinders, may comprise sensing the position of one or more excavator components such that the elevation of the excavator bucket at the worksite may be determined, determining the elevation of the excavator bucket, comparing the elevation of the excavator bucket to the desired elevation of the worksite, supplying movement retarding signals when the excavator bucket approaches the desired elevation, providing hydraulic fluid pressure from the manually actuated joystick valves to the plurality of hydraulic control valves to actuate the hydraulic control valves, and providing a portion of the hydraulic fluid pressure from the manually actuated joystick valves to the hydraulic control valves in opposition to actuation of the hydraulic control valves in response to the movement retarding signals when the bucket approaches the desired elevation, whereby the movement of the bucket below the desired elevation is opposed but not prevented.

The portion of the hydraulic fluid pressure from the manually actuated joystick valves provided in opposition to actuation of the hydraulic control valves may increase as the bucket approaches the desired elevation. The portion of the hydraulic fluid pressure from the manually actuated joystick valves provided in opposition to actuation of the hydraulic control valves may increase linearly as the bucket approaches the desired elevation. A portion, typically less than half, of the maximum hydraulic fluid pressure from the manually actuated joystick valves may be diverted such that the movement of the hydraulic cylinders is slowed but not stopped as the bucket approaches the desired elevation. The portion of the hydraulic fluid pressure diverted by the movement retarding valves may also be substantially constant as the bucket approaches the desired elevation.

BRIEF DESCRIPTION

DETAILED DESCRIPTION

Excavators commonly utilize a variety of sensors to monitor the positions of various machine elements, and to provide displays of those positions for the assistance of the machine operator. In one typical arrangement, a laser transmitter at the worksite projects a thin laser beam that is rapidly rotated about a generally vertical axis to define a reference plane of laser light. If the plane of laser light is horizontal, and if the excavator carries a laser receiver that detects the beam of light and its position relative to the excavator, it is possible for the excavator control to determine the elevation of the receiver. By reference to other sensors on the excavator which sense inclinations of excavator components, or the included angles between various excavator components, such as the boom and the dipper stick, it is possible to determine the elevation of the digging teeth of the excavator bucket and the cut being made by the excavator bucket. If the desired elevation is not uniform over the entire worksite, then it is necessary to know the position of the excavator bucket in three dimensions to determine whether the bucket is above or below the desired worksite contour, and by how much. This may be accomplished in any of a number of ways, including three dimensional positioning with GPS receivers mounted on the excavator. Alternatively, this may be accomplished with precisely located robotic total stations that track excavator movement, or with precisely located laser transmitters that project inclined, fan shaped, multiple beams and with detectors on the excavator. Gyroscopic sensors and magnetic compass sensors may also be used in systems for improved system accuracy.

Figure 1:
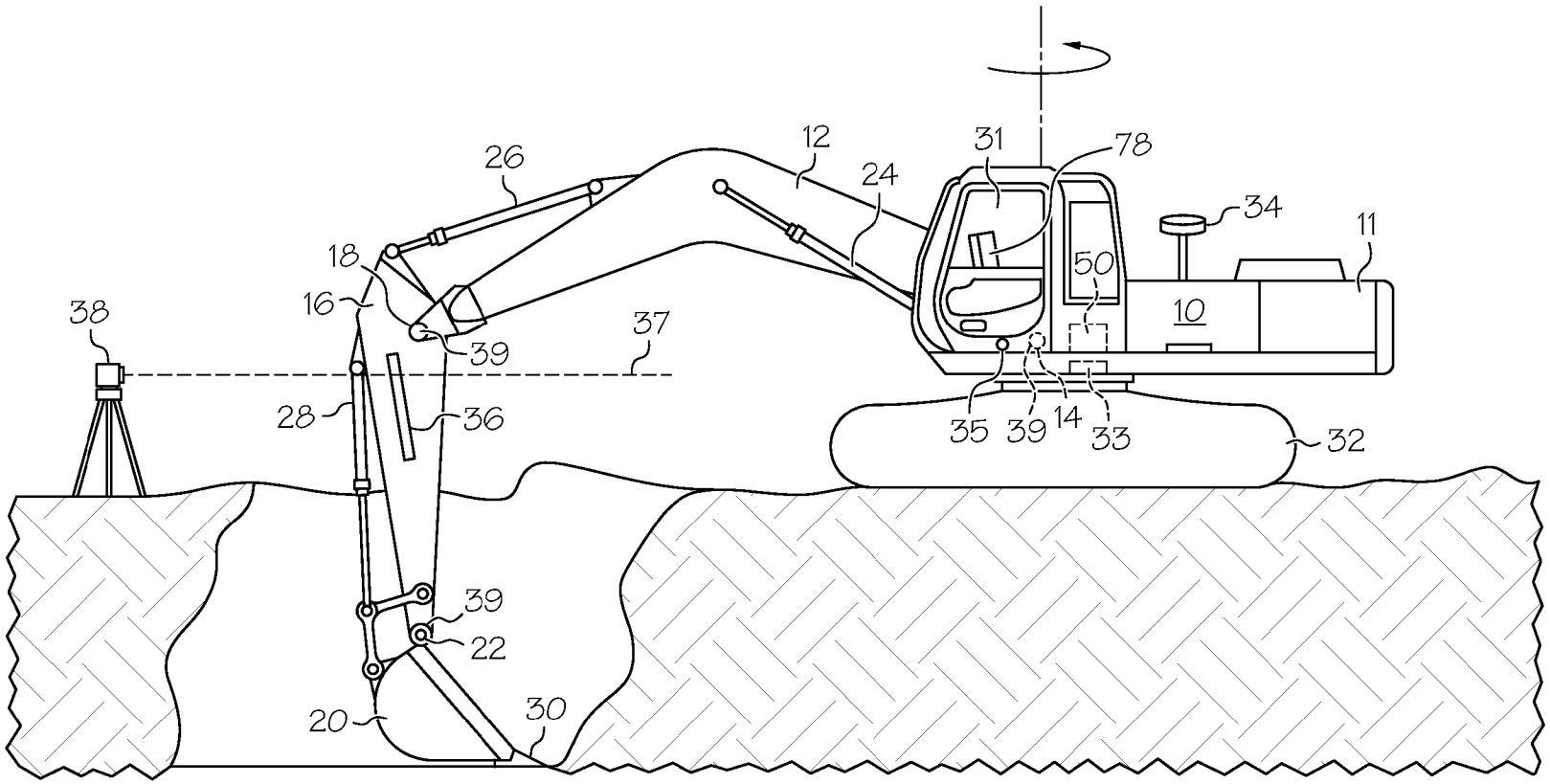
FIG. 1 is a side view of an excavator, illustrating one embodiment of the invention.

FIG. 1 depicts an excavator 10 incorporating an embodiment of the invention. The excavator includes a chassis 11, a boom 12 pivotally secured to the chassis 11 at a first pivot joint 14, a dipper stick 16 pivotally secured to the boom 12 at a second pivot joint 18, and a bucket 20 pivotally secured to the dipper stick 16 at a third pivot joint 22. First, second and third hydraulic devices, comprising first, second, and third hydraulic cylinders 24, 26, and 28, are provided to move the boom 12, dipper stick 16, and bucket 20. Bucket 20 includes a cutting edge 30 that may have serrated teeth to assist in digging. The chassis 11 carries an operator cab 31. The cab 31 is supported on an undercarriage support and transport 32 which may include track belts that facilitate the movement of the excavator 10 over the worksite. The chassis 11 and the components it carries can be rotated about a generally vertical axis by a fourth hydraulic device, such as an hydraulic motor 33, with respect to the undercarriage support and transport 32 to place the bucket 20 at the precise location needed for excavation. It should be appreciated that although the embodiment is shown with a one-piece boom, it is also applicable to excavators having variable angle booms. Further although the excavator is shown as having an excavator bucket, other excavator implements, such as augers, trenchers, and compactors, may also be used.

In the illustrated excavator, information regarding both the location and orientation of the machine is determined using a GPS positioning system, and a magnetic compass 35. The system further includes a laser receiver 36 which receives a reference beam of laser light 37 from a laser transmitter 38. The relative positions of the boom 12, the dipper 16, and the bucket 20 may be determined by angle encoders 39. Alternatively, this information can be provided by reference to gravity based inclinometers mounted to members 12, 16 and 20, or other sensors associated with pivot joints 14, 18, and 22, or by string encoders associated with cylinders 24, 26, and 28, or by some combination of such sensors. The orientation of the excavator 10 with respect to true vertical may be determined by inclinometer 40, mounted on the chassis 11. The inclinometer 40 (FIG. 2) operates in two axes and provides an indication of the angle of roll and the angle of pitch of the chassis 11. The system includes a processor circuit 50, having an associated memory 52 (FIG. 2) that is responsive to all of the sensors 34, 35, 36, 39, and 40, for determining the elevation of the bucket 20 during a digging operation. The processor 50 also determines the difference between the elevation of the bucket 20 and the desired elevation at the digging point on the worksite by reference to data defining the desired topology of the worksite stored in memory 52.

Figure 2:
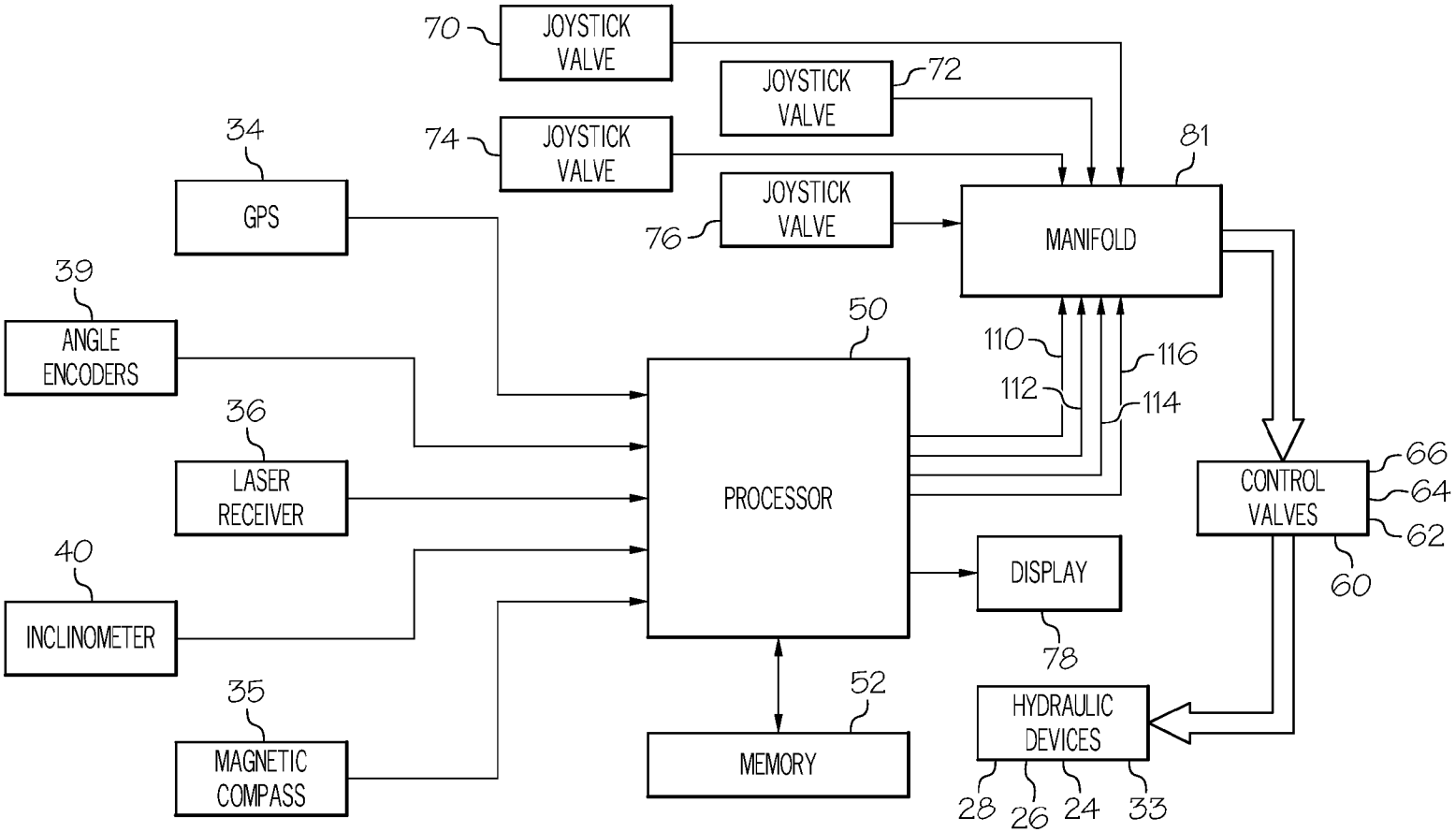
FIG. 2 is a diagrammatic view, illustrating a control system for the excavator of FIG. 1.
Figure 3:
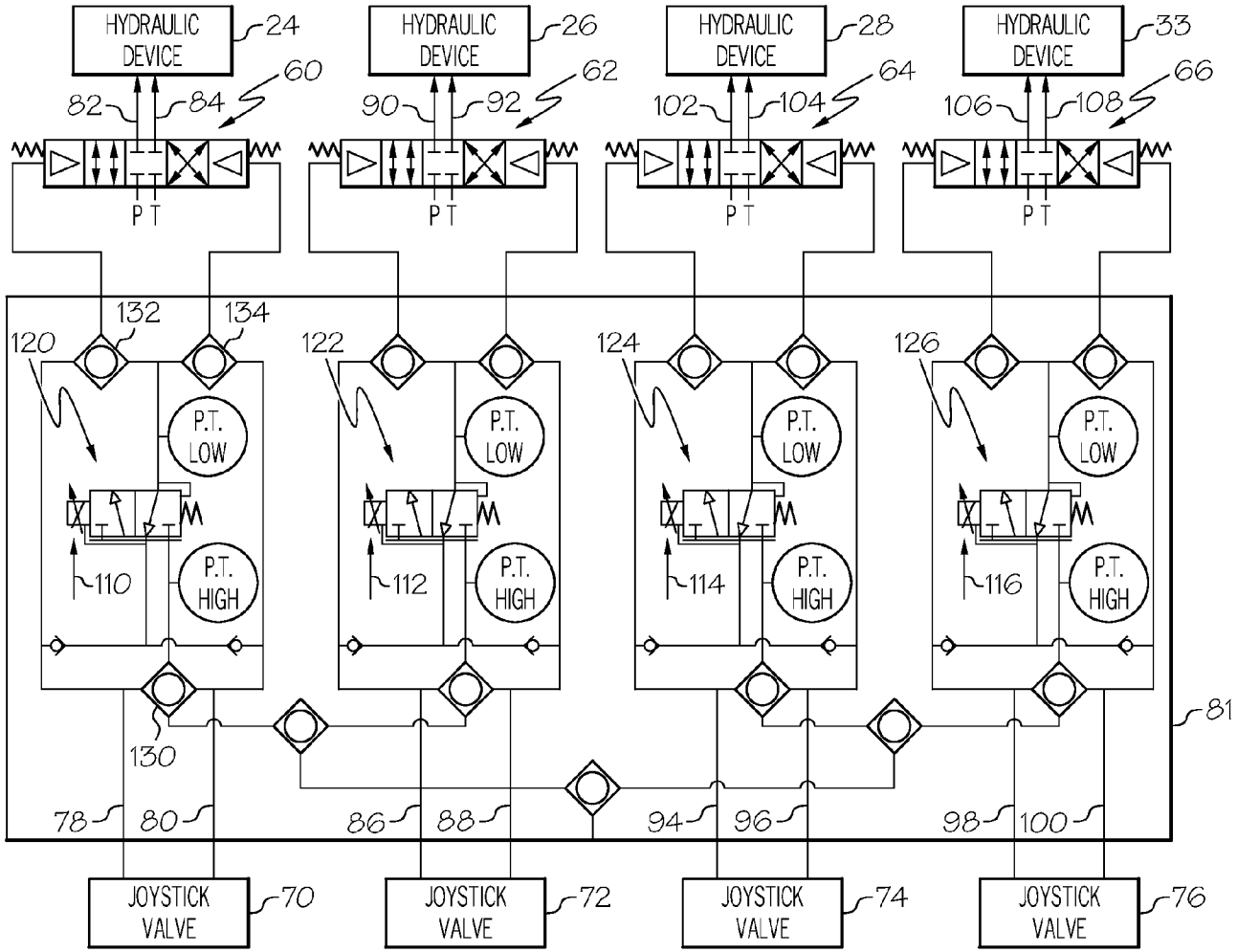
FIG. 3 is a diagrammatic view of the manifold in the control system of FIG. 2, shown in greater detail.

Reference is made to FIGS. 2 and 3, which illustrate the control for the excavator 10. As will be noted, the first, second, third, and fourth hydraulic devices 24, 26, 28, and 33, are controlled by first, second, third, and fourth hydraulic control valves 60, 62, 64, and 66, respectively. Control valves 60, 62, 64, and 66 are spring biased to a center position and actuated by pilot pressure to apply hydraulic flow to either output line at a level commensurate with the applied pilot pressure. The pilot pressure is provided to the hydraulic control valves 60, 62, 64, and 66, by means of manually actuated joystick valves 70, 72, 74, and 76, respectively, typically mounted in pairs per joystick, to control the movement of the first, second, third and fourth hydraulic devices, respectively.

As seen in FIG. 2, the plurality of sensors, including GPS receiver 34, magnetic compass 35, laser receiver 36, angle encoders 39, and inclinometer 40, provide outputs to the processor 50. Processor 50 is also responsive to memory 52. The processor 50 determines the position of the bucket 20 and the teeth 30 accomplishing digging. The processor 50 compares the bucket position to the desired elevation of the worksite and supplies data to display 78. The operator controls the excavator using controls in cab 31, including a pair of joysticks that actuate joystick valves 70, 72, 74, and 76. Fore and aft movement of a first joystick actuates valve 70 to apply hydraulic fluid pressure to line 78 or 80, depending on the direction of movement of the joystick. This is applied through a manifold 81 as pilot pressure to one side or the other of valve 60. As is apparent, pilot pressure applied to one side of valve 60 will cause hydraulic flow into one of lines 82 and 84, while pilot pressure applied to the other side of valve 60 will cause hydraulic flow into the other of lines 82 and 84. As a consequence, the hydraulic device 24, shown in FIG. 1 as an hydraulic cylinder, can be driven to extend or contract depending upon the side of valve 60 to which pilot pressure is applied. Further, the level of hydraulic flow applied to the cylinder 24, and therefore the speed of movement of the cylinder 24, is related to the degree to which the valve 60 is actuated, and therefore to the level of the pilot pressure applied to the valve 60 from the joystick valve 70. The hydraulic device 24 will be actuated in this manner during much of the operation of the excavator.

Actuation of each of the other hydraulic devices 26, 28, and 33 is effected in a similar manner. Side to side movement of the first joystick actuates valve 72 to apply hydraulic fluid pressure to line 86 or 88, depending on the direction of movement of the joystick. This is applied through the manifold 81 as pilot pressure to one side or the other of valve 62. Pilot pressure applied to one side of valve 62 will cause hydraulic flow into one of lines 90 and 92, while pilot pressure applied to the other side of valve 62 will cause hydraulic flow into the other of lines 90 and 92. As a consequence, the hydraulic device 26, shown in FIG. 1 as a hydraulic cylinder, can be driven to extend or contract depending upon the side of valve 62 to which pilot pressure is applied. Further, the level of hydraulic flow applied to the cylinder 26, and therefore the speed of movement of the cylinder 26, is related to the degree to which the valve 62 is actuated, and therefore to the level of the pilot pressure applied to the valve 62 from the joystick valve 72. The hydraulic device 26 will be actuated in this manner during much of the operation of the excavator. Similarly, fore and aft movement of a second joystick and side to side movement of the second joystick actuate valves 74 and 76, respectively to apply hydraulic fluid pressure to lines 94 or 96 and 98 or 100, respectively. Valves 74 and 76 apply hydraulic pressure through the manifold 81 as pilot pressure to one side or the other of valves 64 and 66. Pilot pressure applied to one side of valve 64 will cause hydraulic flow into one of lines 102 and 104, while pilot pressure applied to the other side of valve 64 will cause hydraulic pressure to be applied to the other of lines 102 and 104. Similarly, pilot pressure applied to one side of valve 66 will cause pressure to be applied to one of lines 106 or 108, while pilot pressure applied to the other side of valve 66 will cause hydraulic pressure to be applied to the other of lines 106 and 108. As a consequence, the hydraulic devices 28 and 33, a cylinder and a motor, respectively, can be driven to move in either direction. Further, the level of hydraulic flow applied to the cylinder 28 and the motor 33, and therefore the speed of movement of the cylinder 26 and the motor 33, are related to the degree to which the valve 64 and 66 are actuated, and therefore to the level of the pilot pressure applied to the valves 64 and 66 from the joystick valves 74 and 76. The hydraulic devices 28 and 33 will be actuated in this manner during much of the operation of the excavator.

The mode of operation changes, however, as the elevation at which the excavator is digging approaches the desired elevation for the worksite at that location. The processor 50 is responsive to the sensors 34, 35, 36, 39, and 40, and to the memory 52, for comparing the position of the bucket 20 to the desired elevation of the worksite, and for supplying movement retarding signals if required on lines 110, 112, and 114, to the manifold 81 when the bucket 20 approaches the desired elevation. As described above, the manifold 81 provides hydraulic fluid pressure from the manually actuated joystick valves 70, 72, and 74, to the first, second, and third hydraulic control valves 60, 62, and 64, respectively, to actuate those control valves. When the bucket 20, approaches the desired elevation, and the manifold 81 receives movement retarding signals on any or all lines 110, 112, and 114, the manifold 81 also provides a portion of the hydraulic fluid pressure from those manually actuated joystick valves to any or all of the first, second, and third hydraulic control valves 60, 62, and 64, in opposition to actuation of the valves. As a consequence, the flow of hydraulic fluid supplied to the hydraulic devices 24, 26, and 28 is reduced somewhat and the speed of movement of the hydraulic devices is reduced. It is important to note, however, that the hydraulic devices continue to move in the directions determined by the operation of the joystick valves. This slowing of the movement of the hydraulic cylinders 24, 26, and 28 allows the operator to move the bucket of the excavator about quickly, but then helps the operator to slow the appropriate members moved by the cylinders such that the bucket movement when the digging nears the desired elevation is optimized and does not result in an overcut due to the velocity of one member being too fast in combination with the others. The operation of the manifold 81 does not prevent the bucket from being moved to any location, above or below the desired worksite elevation, since the operator can apply more pilot pressure that the valve 81 can in retarding a particular signal. The operator must actively move the joysticks such that their positions are grossly farther from their center positions than without the opposing pressure supplied by valve 81. The portion of the valve system comprised of joystick 76, through lines 98 and 100 to spool 66 and controlling motor 33 can be affected by EH valve 126 so as to slow motor 33 to prevent the positioning of the machine by rotation into an area that is identified in the design model for a variety of reasons, but assumed to be for safety or alignment during unloading or positioning over an alignment feature within the design. Further, since the retarding of the movement of the devices 24, 26, 28 and 33 is accomplished by diverting some of the hydraulic fluid pressure from the joystick valves, the manifold cannot inadvertently cause actuation of a control valve 60, 62, 64, or 66 in the absence of actuation of one or more joystick valves 70, 72, 74, and 76.

The manifold 81 incorporates a plurality of movement retarding valves, each responsive to one of the movement retarding signals on lines 110, 112, 114, and 116 from the processor 50, for diverting a portion of the hydraulic fluid pressure from the manually actuated joystick valves 70, 72, 74, and 76, to oppose actuation of the plurality of hydraulic control valves 60, 62, 64, and 66. More specifically, the manifold 81 includes a first movement retarding valve 120, responsive to the movement retarding signal on line 110, for diverting a portion of the hydraulic fluid pressure from the manually actuated joystick valve 70 to oppose actuation of the first hydraulic control valve 60. The manifold 81 includes a second movement retarding valve 122, responsive to the movement retarding signal on line 112, for diverting a portion of the hydraulic fluid pressure from the manually actuated joystick valve 72 to oppose actuation of the second hydraulic control valve 62. The manifold 81 includes a third movement retarding valve 124, responsive to the movement retarding signal on line 114, for diverting a portion of the hydraulic fluid pressure from the manually actuated joystick valve 74 to oppose actuation of the third hydraulic control valve 64. Finally, the manifold 81 includes a fourth movement retarding valve 126, responsive to the movement retarding signal on line 126, for diverting a portion of the hydraulic fluid pressure from the manually actuated joystick valve 76 to oppose actuation of the fourth hydraulic control valve 66. Each of the movement retarding valves 120, 122, 124, and 126 comprises an electrically actuated proportional valve. Each of the movement retarding valves 120, 122, 124 and 126 diverts a portion of the hydraulic fluid pressure from the associated manually actuated joystick valve such that the movement of the hydraulic devices is slowed, as the bucket approaches the desired elevation or alignment. The portion of the hydraulic fluid pressure diverted by the movement retarding valves 120, 122, 124, and 126 may gradually increase as the bucket approaches the desired elevation or alignment, decreasing the speed of movement of the devices 24, 26, 28 and 33 more or less linearly. Alternatively, the degree to which the hydraulic devices are slowed may be constant when the bucket 20 is within a certain predetermined distance of the desired elevation. As yet another alternative, the degree to which hydraulic devices are slowed may change in a series of steps as the bucket 20 approaches the desired elevation or alignment for the particular design.

Referring to FIG. 3, it will be seen that the hydraulic lines and valves associated with each of the movement retarding valves 120, 122, 124, and 126 is identical, so an explanation of the operation of valve 120 will suffice to explain the operation of all of the valves. Assume that the joystick valve 70 is actuated such that pressure is applied to line 78. Shuttle valve 130 will be biased to the right and hydraulic fluid pressure will be applied to the left side of control valve 60 through shuttle valve 132, with the result that control valve 60 will be shifted to the right against the centering spring bias force. This will, in turn, cause hydraulic fluid p flow into line 82. If, however, a signal on line 110 actuates proportional valve 120, a part of the hydraulic fluid pressure from line 78 will pass through shuttle valve 130, through EH valve 120 and shuttle valve 134, and be applied to the right side of valve 60. This hydraulic fluid pressure will oppose and thus reduce, but not prevent, the actuation of valve 60 by pressure in line 78, reducing the flow of fluid applied to hydraulic device 24 via line 82. When the bucket 20 moves in such a way that it will not move deeper than the desired elevation of the worksite, however, the movement retarding signal on line 110 may be terminated, with result that the actuation of the valve 60 is no longer opposed, and the hydraulic device 24 resumes movement at a higher speed.

It will be seen that this arrangement permits the operator to control the excavator in such a way that the bucket is moved quickly, for example when swinging the bucket to a position where a load of dirt is to be dumped into a truck. The system only subtly slows the digging operation when the operator moves the bucket to make a digging cut at or near the desired final grade or rotationally move toward an alignment feature for the worksite. This enhances the speed of operation and the efficiency of the excavator.

What is claimed is:

1. An excavator having an excavator chassis pivotally mounted on an excavator undercarriage, a boom pivotally mounted on the excavator chassis, a dipper stick pivotally mounted on the boom, an excavator implement pivotally mounted on the dipper stick, a first hydraulic device for moving said implement with respect to the dipper stick, a first hydraulic control valve for controlling the application of hydraulic fluid to said first hydraulic device, a second hydraulic device for moving said dipper stick with respect to said boom, second hydraulic control valve for controlling the application of hydraulic fluid to said second hydraulic device, a third hydraulic device for moving said boom with respect to said excavator chassis, a third hydraulic control valve for controlling the application of hydraulic fluid to said third hydraulic device, a fourth hydraulic device for rotating said chassis with respect to said undercarriage, a fourth hydraulic control valve for controlling the application of hydraulic fluid to said fourth hydraulic device, and manually actuated joystick valves for supplying hydraulic fluid pressure to said first, second, third and fourth hydraulic control valves, to control the movement of said first, second, third and fourth hydraulic devices, respectively, further comprising:

a plurality of sensors for sensing position, a memory storing the desired elevation of the worksite at the point being excavated, a processor, responsive to said sensors and to said memory, for determining the position of the implement, for comparing the implement position to the desired elevation of the worksite, and for supplying movement retarding signals when said implement approaches the desired elevation, and a manifold providing hydraulic fluid pressure from said manually actuated joystick valves to said first, second, third and fourth hydraulic control valves, to actuate said first, second, third and fourth hydraulic control valves, and for providing a portion of said hydraulic fluid pressure from said manually actuated joystick valves to said first, second, third and fourth hydraulic control valves in opposition to actuation of said first, second, third and fourth hydraulic control valves in response to said movement retarding signals from said processor when said implement approaches the desired elevation, whereby the movement of said implement below said desired elevation is opposed.

2. The excavator of claim 1, in which the manifold includes;

a first movement retarding valve, responsive to said movement retarding signals, for diverting a portion of the hydraulic fluid pressure from said manually actuated joystick valves to oppose actuation of said first hydraulic control valve, a second movement retarding valve, responsive to said movement retarding signals, for diverting a portion of the hydraulic fluid pressure from said manually actuated joystick valves to oppose actuation of said second hydraulic control valve, a third movement retarding valve, responsive to said movement retarding signals, for diverting a portion of the hydraulic fluid pressure from said manually actuated joystick valves to oppose actuation of said third hydraulic control valve, and a fourth movement retarding valve, responsive to said movement retarding signals, for diverting a portion of the hydraulic fluid pressure from said manually actuated joystick valves to oppose actuation of said fourth hydraulic control valve.

3. The excavator of claim 2 in which said first, second, third, and fourth movement retarding valves each comprises an electrically actuated proportional pressure reducing valve.

4. The excavator of claim 3 in which said first, second, third and fourth movement retarding valves divert a portion of the hydraulic fluid pressure from said manually actuated joystick valves such that the movement of said hydraulic devices is slowed as said implement approaches the desired elevation.

5. The excavator of claim 3 in which the portion of the hydraulic fluid pressure diverted by said movement retarding valves increases as said implement approaches the desired elevation.

6. A control for an excavator, having a plurality of hydraulic cylinders for moving excavator components such that operation is accomplished at a worksite with an excavator implement, a plurality of hydraulic control valves, each of which is associated with a respective one of said hydraulic cylinders for controlling the application of hydraulic fluid pressure to said respective one of said hydraulic cylinders, and a plurality of manually actuated joystick valves for supplying hydraulic fluid pressure to said respective hydraulic control valves to control the movement of said hydraulic cylinders, said control comprising a sensor arrangement for sensing the position of one or more excavator components such that the elevation of the excavator implement at the worksite may be determined, a memory storing the desired elevation of the worksite, a processor, responsive to said sensor arrangement and to said memory, for determining the elevation of the excavator implement, for comparing the elevation of the excavator implement to the desired elevation of the worksite, and for supplying movement retarding signals when said excavator implement approaches the desired elevation, and a manifold providing hydraulic fluid pressure from said manually actuated joystick valves to said plurality of hydraulic control valves to actuate said hydraulic control valves, and for providing a portion of said hydraulic fluid pressure from said manually actuated joystick valves to said hydraulic control valves in opposition to actuation of said hydraulic control valves in response to said movement retarding signals from said processor when said implement approaches the desired elevation, whereby the movement of said implement below said desired elevation is opposed but not prevented.

7. The control for an excavator of claim 6, in which said manifold includes a plurality of movement retarding valves, responsive to said movement retarding signals, for diverting a portion of the hydraulic fluid pressure from said manually actuated joystick valves to oppose actuation of said plurality of hydraulic control valves.

8. The control for an excavator of claim 7, in which in which each of said plurality of movement retarding valves comprises an electrically actuated proportional valve.

9. The control for an excavator of claim 8, in which said plurality of movement retarding valves divert a portion of the hydraulic fluid pressure from said manually actuated joystick valves such that the movement of said hydraulic cylinders is slowed but not stopped as said implement approaches the desired elevation.

10. The control for an excavator of claim 8, in which the portion of the hydraulic fluid pressure diverted by said movement retarding valves controls by limiting the velocity the said implement approaches the desired elevation.

11. A control for an excavator, having a plurality of hydraulic cylinders for moving excavator components such that operation is accomplished at a worksite with an excavator implement, a plurality of hydraulic control valves, each of which is associated with a respective one of said hydraulic cylinders for controlling the application of hydraulic fluid flow to said respective one of said hydraulic cylinders, and a plurality of operator interface valves for supplying hydraulic fluid pressure to said respective hydraulic control valves to control the movement of said hydraulic cylinders, said control comprising a sensor arrangement for sensing the position of one or more excavator components such that the elevation of the excavator implement at the worksite may be determined, a memory storing the desired elevation of the worksite, a processor, responsive to said sensor arrangement and to said memory, for determining the elevation of the excavator implement, for comparing the elevation of the excavator implement to the desired elevation of the worksite, and for supplying movement retarding signals when said excavator implement approaches the desired elevation, and a manifold providing hydraulic fluid pressure from said operator interface valves to said plurality of hydraulic control valves to actuate said hydraulic control valves, and for providing a portion of said hydraulic fluid pressure from said operator interface valves to said hydraulic control valves in opposition to actuation of said hydraulic control valves in response to said movement retarding signals from said processor when said implement approaches the desired elevation, whereby the movement of said implement below said desired elevation is opposed but not prevented.

12. The control for an excavator of claim 11, in which said manifold includes a plurality of movement retarding valves, responsive to said movement retarding signals, for diverting a portion of the hydraulic fluid pressure from said manually actuated joystick valves to oppose actuation of said plurality of hydraulic control valves in response to said movement retarding signals.

13. The control for an excavator of claim 12, in which each of said plurality of movement retarding valves comprises an electrically actuated proportional valve.

14. The control for an excavator of claim 13, in which said plurality of movement retarding valves divert a portion of the hydraulic fluid pressure from said manually actuated joystick valves such that the movement of said hydraulic cylinders is slowed but not stopped as said implement approaches the desired elevation.

15. The control for an excavator of claim 13, in which the portion of the hydraulic fluid pressure diverted by said movement retarding valves increases as said implement approaches the desired elevation.

16. A method of controlling an excavator of the type having a plurality of hydraulic cylinders for moving excavator components such that operation is accomplished at a worksite with an excavator implement, a plurality of hydraulic control valves, each of which is associated with a respective one of said hydraulic cylinders for controlling the application of hydraulic fluid flow to said respective one of said hydraulic cylinders, and a plurality of manually actuated joystick valves for supplying hydraulic fluid pressure to said respective hydraulic control valves to control the movement of said hydraulic cylinders, comprising:

sensing the position of one or more excavator components such that the elevation of the excavator implement at the worksite may be determined, determining the elevation of the excavator implement, comparing the elevation of the excavator implement to the desired elevation of the worksite, supplying movement retarding signals when said excavator implement approaches the desired elevation, providing hydraulic fluid pressure from said manually actuated joystick valves to said plurality of hydraulic control valves to actuate said hydraulic control valves, and providing a portion of said hydraulic fluid pressure from said manually actuated joystick valves to said hydraulic control valves in opposition to actuation of said hydraulic control valves in response to said movement retarding signals when said implement approaches the desired elevation, whereby the movement of said implement below said desired elevation is opposed but not prevented.

17. The method of claim 16, in which the portion of said hydraulic fluid pressure from said manually actuated joystick valves provided in opposition to actuation of said hydraulic control valves increases as said implement approaches the desired elevation.

18. The method of claim 17, in which the portion of said hydraulic fluid pressure from said manually actuated joystick valves provided in opposition to actuation of said hydraulic control valves increases linearly as said implement approaches the desired elevation.

19. The method of claim 18, in which a portion of the hydraulic fluid pressure from said manually actuated joystick valves is diverted such that the movement of said hydraulic cylinders is slowed but not necessarily stopped as said implement approaches the desired elevation.

20. The method of claim 18, in which the portion of the hydraulic fluid pressure diverted by said movement retarding valves is substantially constant as said implement approaches the desired elevation.

* * * * *

UNITED STATES PATENT AND TRADEMARK OFFICE

CERTIFICATE OF CORRECTION

PATENT NO. : 8,689,471 B2
APPLICATION NO. : 13/527095
DATED : April 8, 2014
INVENTOR(S) : Hamish John Carpenter et al.

It is certified that error appears in the above-identified patent and that said Letters Patent is hereby corrected as shown below:

In the Claims

Col. No. 10, Lines 62-63, Claim No. 8 "of claim 7, in which in which each of" should read --of claim 7, in which each of--

Signed and Sealed this
Eighth Day of September, 2015

Michelle K. Lee

Michelle K. Lee
*Director of the United States Patent and Trademark Office*